United States Patent [19]

Zozzaro

[11] 3,984,162

[45] Oct. 5, 1976

[54] UTILITY WAGON

[75] Inventor: Frank Zozzaro, Middletown, N.J.

[73] Assignee: Lawrence Peska Associates, Inc., New York, N.Y. ; a part interest

[22] Filed: Apr. 21, 1975

[21] Appl. No.: 570,246

[52] U.S. Cl. ..... 312/100; 312/235 R; 312/250; 312/290; 312/321

[51] Int. Cl.[2] ..... A47B 77/00; A47B 77/04; A47B 81/00

[58] Field of Search ..... 312/10, 235, 250, 290, 312/320, 321, 100

[56] References Cited

UNITED STATES PATENTS

| | | | |
|---|---|---|---|
| 309,192 | 12/1884 | Brothers | 312/290 X |
| 767,908 | 8/1904 | Miller | 312/236 X |
| 1,030,534 | 6/1912 | Pooler | 312/10 |
| 1,216,030 | 2/1917 | Wiggins | 312/236 |
| 1,409,445 | 3/1922 | Hillyer et al. | 312/236 |
| 1,543,980 | 6/1925 | Blood | 312/290 |
| 1,865,618 | 7/1932 | Dahlman et al. | 312/250 X |
| 1,884,325 | 10/1932 | Sommer | 312/290 |
| 2,690,368 | 9/1954 | Troyke | 108/33 X |

*Primary Examiner*—Paul R. Gilliam
*Assistant Examiner*—Carl F. Pietruszka

[57] ABSTRACT

A utility wagon for use with outdoor living equipment which includes a floor, upstanding side and back members and a generally planar shelf member. Depending generally planar dividers are carried by the shelf member and upstanding generally planar divider members are carried by the floor member for holding a plurality of seating devices neatly within the interior of the cart.

1 Claim, 2 Drawing Figures

FIG. 1
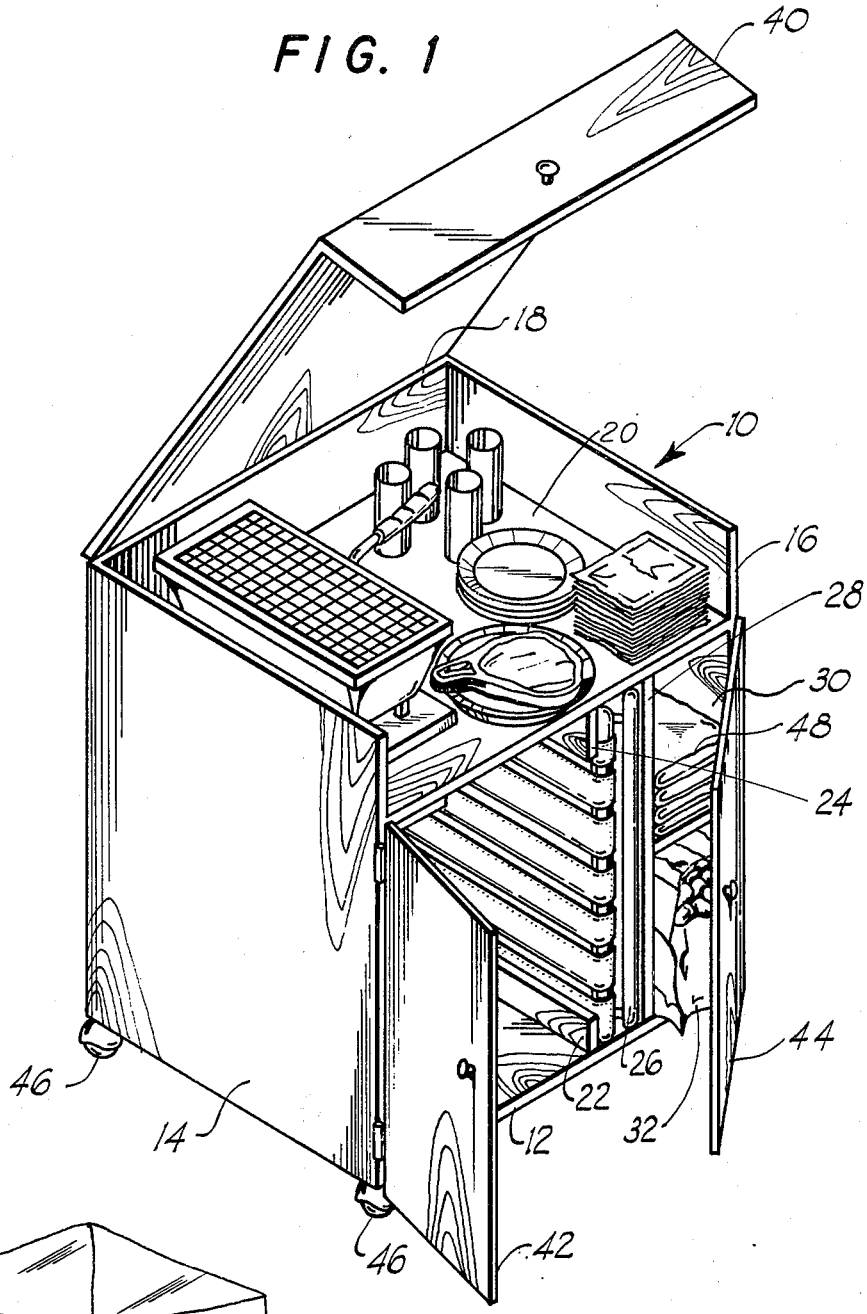
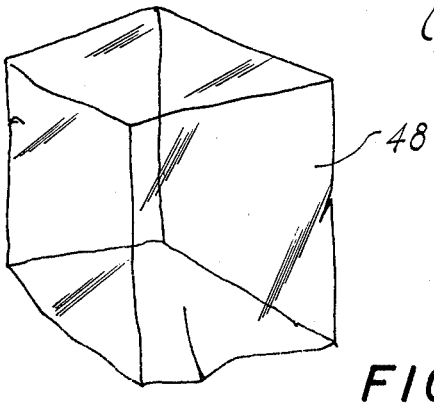
FIG. 2

UTILITY WAGON

BACKGROUND OF THE INVENTION

The invention relates to utility carts particularly those for carrying cooking and serving equipment normally used on patios and apartment balconies. The prior art includes various structures having a general similarity to present invention which do not provide the convenience which is possible therewith. These include the apparatus shown in the following U.S. Pat. Nos. 3,573,879; 3,118,685; 1,149,639; and 2,893,749. The apparatus therein is generally suited for particular applications such as for cleaning implements, tools, or for carrying a variety of items necessary for cleaning hotel rooms. Such apparatus has not met the requirements of the market place for apparatus for patio and apartment balcony applications as heretofore described.

It is a primary object of the invention to provide apparatus which is particularly suited for carrying serving and dining apparatus.

It is still another object of the invention to provide such apparatus which is simple and inexpensive to manufacture.

SUMMARY OF THE INVENTION

It has now been found that these and other objects of the invention may be attained by a utility wagon which includes a generally planar rectangular floor. Upstanding generally planar side members and perpendicular thereto a back member also in upstanding relationship to the generally planar rectangular floor member is provided. Each member is disposed about the circumference of the floor. A generally planar shelf is carried on the side members and the back member. A plurality of spaced depending generally planar dividers extend from the bottom of the shelf. Each divider is disposed in generally planar relationship to the side. A plurality of spaced depending generally depending dividers extends in upstanding relationship from the base and each is spaced from the generally planar side members a distance equal to the spacing of one of the depending dividers.

One of the dividers may extend from the shelf to the floor in one form of the invention and may be disposed in generally parallel relationship to the sides of the cart.

A door may be provided hinged on one side member for selective closing of the cavity defined by the side members, the floor, the shelf and the back member.

BRIEF DESCRIPTION OF THE DRAWING

The invention will be better understood by reference to the accompanying drawing in which:

FIG. 1 is a perspective view of the apparatus in accordance with the invention; and FIG. 2 is a perspective view of a cover suitable for use with the apparatus.

DESCRIPTION OF THE PREFERRED EMBODIMENT

Referring now to FIGS. 1 and 2 there is shown a utility cart 10 in accordance with the invention. The cart includes a generally planar floor 12 which has disposed about the circumference thereof opposed side members 14, 16 and a back member 18. It will be understood that the side members 14, 16 are disposed in generally parallel relationship and are generally planar. The back member is also generally planar and is disposed in generally perpendicular relationship to the side members 14, 16. A shelf 20 is carried by the side member 14, 16 and the back member 18. The shelf 20 is generally planar and disposed in generally parallel relationship to the floor 12.

Generally planar dividers 22 are disposed in generally parallel relationship to the side members 14, 16 and in upstanding relationship to the floor 12. Disposed in depending relationship to the shelf 20 are a plurality of dividers 24 which are also generally planar and disposed in parallel relationship to the side members 14, 16. It will be understood that although one divider 22 and one divider 24 are shown that in the preferred form of the invention a plurality of such dividers will be provided to constrain a plurality of chairs or seats 26. A large generally planar member 28 may be provided which is also disposed in parallel relationship to the side members 14, 16 and extends from the shelf 20 to the floor 12. Divider 28 defines compartments 30, 32 the entire apparatus is enclosed by means of a hinged door 40 carried on the top of the cart 10 and side doors 42, 44. Casters 46 (two shown) are disposed at each corner of the apparatus in accordance with the invention. A separate cover 48 which is manufactured of a flexible material is provided for enclosing the entire cart 10 when it is not in use. When the cart is in use it may be folded and placed within the compartment 30.

Having thus described my invention, I claim:

1. A utility wagon, which comprises:

a. a planar floor;

b. a back member extending upwardly from said planar floor;

c. a pair of side members extending upwardly from said planar floor, said side members joined perpendicularly to said back member;

d. a plurality of caster members affixed to a bottom surface of said planar floor, each said caster member extending downwardly from said planar floor, each said caster member engaging a floor for horizontal movement of said wagon;

e. a shelf member joined to said side member and said back member, said shelf member parallel to said planar floor, said shelf member disposed below upper edges of said side member and said back member;

f. a plurality of first planar dividers disposed in generally parallel relationship to said side members and in upstanding relationship to said planar floor;

g. a plurality of second planar dividers disposed in depending relationship to said shelf, each said second divider extending downwardly from said shelf and aligned with one of said first dividers to form a divider spaced between each two said second dividers, each said divider space adapted to provide for storage of individual folding chairs;

h. one planar member extending between said planar floor and said shelf, said planar member disposed in parallel relationship to said side members;

i. a door member hingeably joined to a forward edge of each said side member, each said door member extending between said shelf and said planar floor; and j. a cover hingeably joined to said upper edge of said back member, said cover including a top planar portion and a planar flange, said flange extending perpendicularly downward from a forward edge of said top planar portion, said top portion resting on said upper edges of said side members.

* * * * *